US008321079B2

(12) United States Patent
Degouge et al.

(10) Patent No.: US 8,321,079 B2
(45) Date of Patent: Nov. 27, 2012

(54) ANTI-COLLISION CONTROL SYSTEM FOR A VEHICLE

(75) Inventors: Regis Degouge, Brooklyn, NY (US); Laurent Pinori, Paris (FR); Stephane Callet, Meudon (FR)

(73) Assignee: Siemens SAS, St. Denis (FR)

( * ) Notice: Subject to any disclaimer, the term of this patent is extended or adjusted under 35 U.S.C. 154(b) by 480 days.

(21) Appl. No.: 12/526,350

(22) PCT Filed: Feb. 7, 2007

(86) PCT No.: PCT/FR2007/000218

§ 371 (c)(1),
(2), (4) Date: Aug. 7, 2009

(87) PCT Pub. No.: WO2008/096048

PCT Pub. Date: Aug. 14, 2008

(65) Prior Publication Data

US 2010/0090069 A1 Apr. 15, 2010

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl. ..... 701/19

(58) Field of Classification Search ..... 701/19
See application file for complete search history.

(56) References Cited

U.S. PATENT DOCUMENTS

| | | | | |
|---|---|---|---|---|
| 3,817,344 | A * | 6/1974 | Asano et al. | 180/168 |
| 4,791,871 | A * | 12/1988 | Mowll | 104/94 |
| 5,388,789 | A * | 2/1995 | Rudershausen | 246/167 D |
| 5,954,780 | A * | 9/1999 | Jang | 701/93 |

FOREIGN PATENT DOCUMENTS

| | | |
|---|---|---|
| EP | 1552997 A2 | 7/2005 |
| EP | 1614604 A1 | 1/2006 |
| EP | 1630059 A2 | 3/2006 |

OTHER PUBLICATIONS

Lundsten, Carsten "North american signaling: Absolute Permissive Block", Jan. 10, 2000 availble online @ http://www.lundsten.dk/us_signaling/abs_apb/index.html#prot_appr, last accessed Dec. 5, 2011.*

(Continued)

*Primary Examiner* — Mary Cheung
*Assistant Examiner* — Daniel L Greene
(74) *Attorney, Agent, or Firm* — Laurence A. Greenberg; Werner H. Stemer; Ralph E. Locher

(57) ABSTRACT

An anti-collision control system for one or more vehicles fitted with an onboard automatic pilot (self-guiding) allowing for bi-directional movements on a single track under the control of a ground-based automated traffic control unit of the CBTC (Communication Based Train Control) type. The system includes: a signaling control unit of the AWS (Auxiliary Wayside System) type for controlling ground signals on a section of a single-direction circulation lane; a first default control means based on which the signaling control unit imposes a single-direction movement to the vehicle running on the section of a single-direction circulation lane in order to avoid any collision with another vehicle controlled solely by the signaling control unit of the AWS type, i.e. independently from the ground-based automated traffic control unit.

16 Claims, 2 Drawing Sheets

OTHER PUBLICATIONS

Ritter N: "Einfuehrungsstrategien Fuer Die Automatisierung Von Nahverkehrsbahnen Introductory Strategies for the Automation of Suburban Railway Systems Strategies De Deploiement Pour L'Automatisation Des Systemes De Transport a Courte Distance" Zeitschrift Fur Eisenbahnwesen Und Verkehrstechnik. Die Eisenbahntechnik + Glasers Annalen, Georg Siemens Verlagsbuchhandlung. Berlin, DE, vol. 125, No. 4, Apr. 1, 2001, pp. 129-137.

Schuette J et al: "Der Weg Zur Einfuehrung Des Automatischen Fahrbetriebs Bei Vorhandenen U- Und Stadtbahnen" Signal + Draht, Telzlaff Verlag GMBH. Darmstadt, DE, vol. 87, No. 7/8, Jul. 1995, pp. 264-268, XP000723325 ISSN: 0037-4997—Statement of Relevance.

Mueller R et al: "Eine Automatische U-Bahn. Technische Besonderheiten Der Agt-Fahrzeuge Fuer Nuernberg" ETR Eisenbahntechnische Rundschau, Hestra-Verlag. Darmstadt, DE, vol. 52, Nov. 2003, pp. 679-685, XP001536300—Statement of Relevance.

Ahlqvist P et al: "Mixed Signalling—Conventional Signalling and ERTMS on One Line Gemischte Signalisierung—Konventionelle Signalisierung Und ERTMS Auf Einer Strecke" Signal + Draht, Tetzlaff, Hamburg, DE, Dec. 2005, pp. 47-49, XP001236367 ISSN: 0037-4997.

* cited by examiner

ANTI-COLLISION CONTROL SYSTEM FOR A VEHICLE

BACKGROUND OF THE INVENTION

Field of the Invention

The present invention relates to an anti-collision control system for a vehicle, i.e., for at least a first vehicle with on-board automatic vehicle operation, allowing bi-directional motions on a single track under the control of a ground-based automated traffic control unit. A signaling control unit controls ground-based signals on a track section with mono-directional running. The system has a first default control mode according to which the signaling control unit imposes a mono-directional motion to the vehicle moving on the mono-directional running track section.

The invention is appropriate in particular for a vehicle, for which it is implied that various types of locomotion means are concerned, more particularly in the area of passenger transport or/and of transport of goods. So, a rail transport such as a train and its passenger cars or freight cars on rails, a tramway, but also a train on tires, with or without rail, a trolleybus or a bus with at least one compartment, as simple examples, are a part of the invention. In particular, some of those vehicles can comprise means of supervision or of control, also commonly called controllers, which allow to generate or to execute control applications, for example for an assisted-guiding of the vehicle, even the self-guiding of the vehicle if said vehicle does not have a driver or can free itself from it.

For clarity reasons, the invention will be explained on an example of vehicle, such as a first vehicle guided on a rail track. An anti-collision control system for at least this first vehicle is well-known today, if the vehicle is supplied with an on-board automatic vehicle operation, allowing bi-directional motions on a sole track under the control of an automated traffic control unit, of ground-based ATC (Automatic Train Control) or CBTC (Communication Based Train Control) type as it is called afterwards in the invention. As it happens, this guiding system is particularly well suited for a train or for a shuttle without driver which can do round-trips on the same track or an about-turn by changing of track of mono-directional type. However, this first vehicle supplied with an automatic vehicle operation, runs on track parts for which a signalling control unit, of AWS (Auxiliary Wayside System) type as it is called afterwards, controls ground-based signals on a mono-directional running track section, AWS TS (Traffic Section controlled by AWS) or of AWS TS type as it is called afterwards. Those signals can be signalling lights, controlled by electrical or mechanical relays, etc, generally used for vehicles manually operated by a driver. On such sections AWS TS, there is a first default control mode according which the signalling control unit AWS imposes a mono-directional motion to each vehicle moving on the mono-directional running track section AWS TS (the sole direction is controlled by the signalling control unit AWS). In short, the signalling control unit AWS imposes a control priority on the automated traffic control unit CBTC, in particular so as to avoid a collision of the first vehicle with another vehicle without automatic vehicle operation and yet moving on the same track as the first train. This control priority can also be used to force the first equipped vehicle which is moving on a track part in self-guided mode to answer an order (braking, blocking, etc).

Thus, because of the control priority of the signalling control unit AWS on the self-guided vehicle, a first anti-collision system is known, in order to limit runs in opposite directions of the self-guided vehicle which could put in jeopardy other vehicles coming closer to it. This control priority with a safety effect however restricts the ability of bi-directional moving of the first self-guided vehicle.

Two examples well-known and illustrating the control priority are then given by the following figures:

DESCRIPTION OF THE INVENTION

Figure 1:
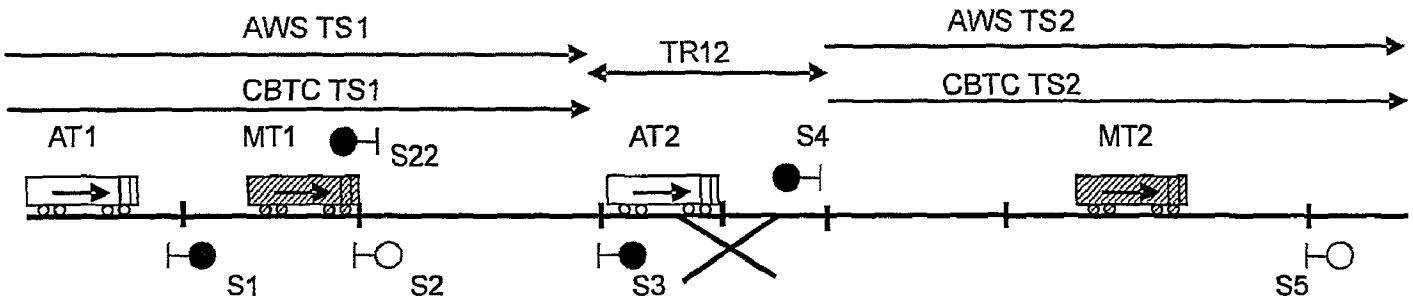
FIG. 1 PRIOR ART
FIG. 1: an anti-collision system appropriate for vehicles with automatic vehicle operation and for vehicles with manual vehicle operation.

FIG. 1 represents a (rail) track on which are running two first self-guided vehicles AT1, AT2 and two other vehicles MT1, MT2 guided manually, through at least one signalling control unit of AWS type comprising signals of "manual" type S1, S2, S22, S3, S4, S5 (for example blocking green/red lights). The two first vehicles AT1, MT1 of different types—automatic and manual—are on a track section AWS TS1 (of AWS TS type) which, itself, can be controlled by an automated traffic control unit CBTC (not shown) on the same track part CBTC TS1 (of CBTC TS type) according to one direction or another. Because of the presence of the two vehicles AT1, MT1 on this common part AWS TS1, CBTC TS1, the control priority of the signalling control unit AWS (not shown) prevails over the automated traffic control unit CBTC, in order to maintain a strictly mono-directional running for the two vehicles MT1, AT1 even if the self-guided vehicle AT1 has the ability to run in opposite directions on the track. So, the vehicle All initially self-guided is entirely controlled by the signalling control unit AWS.

A second track section AWS TS2 controlled by a signalling control unit of AWS type is juxtaposed to the previous AWS TS1 section of the same AWS type, however through a transit zone TR12 only under the control of the signalling control unit AWS or of another similar network. The transit zone TR12 comprises, according to FIG. 1, a vehicle AT2 of self-guided type and moving towards the second track section AWS TS2, on which a vehicle MT2 with manual vehicle operation is controlled by a signalling control unit of AWS type. The zone of track system AWS TS12 does not comprise any link with any automated traffic control unit CBTC; this is why the vehicle AT2, even self-guided, remains under the control of the signalling control unit of AWS type on which it is running. In FIG. 1 and similarly to the first track section, a track section CBTC TS2 is also designed for a self-guided train by the second track section AWS TS2 controlled by a signalling control unit of AWS type. In particular, the self-guided vehicle AT2 is on approach of the second track section AWS TS2 which also comprises a second vehicle MT2 of manual type and running in a defined direction. If this direction is opposite to the one of the first self-guided vehicle AT2 then going in the second track section AWS TS2, the control priority of the signalling control unit of AWS type prevails over a self-guiding of the first self-guided vehicle AT2. If that is not the case, the signalling is permissive and authorizes a going in and a moving on the second part AWS TS2 of AWS type. However, on this last part, an automated traffic control unit CBTC cannot in any way modify the moving direction of the self-guided vehicle AT2, because said moving direction is imposed by the defined direction of the manual vehicle MT2, which ensures that the self-guided vehicle AT2 cannot collide with the manual vehicle MT2.

Figure 2:
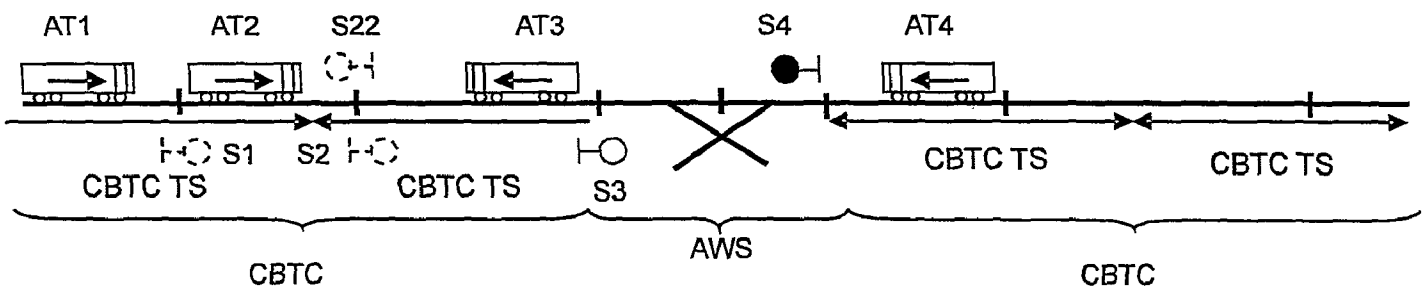
FIG. 2 PRIOR ART
FIG. 2: an anti-collision system appropriate for vehicles with automatic vehicle operation.

FIG. 2 now represents an example which distribution of the tracks is similar to the one of FIG. 1. On the other hand, four self-guided vehicles AT1, AT2, AT3, AT4 are present and run on each one on the first part CBTC TS1, on the transit zone TR12 and on the second part CBTC TS2. Because of the absence of vehicle of manual type and besides the presence of ground-based signalling, the first and the second track parts CBTC TS1, CBTC TS2 are not anymore under the control priority of a signalling control unit of AWS type. In other words, on those same track sections CBTC TS1, CBTC TS2, all the self-guided vehicles can be self-guided in opposite directions without risk of collision under the control of the automated traffic control unit CBTC which protects all the vehicles from a risk of collision. All the signals (of visual type for example) S1, S2, S22, S3 are then inhibited/switched-off on those sections, in order not to mislead a vehicle, in a conflicting way with the instructions of the automated traffic control unit CBTC. The signals S4, S5 here are out of section of CBTC TS type: so they are still able to be activated by the signalling control unit AWS. However, if a vehicle with a mono-directional manual vehicle operation had to approach or go in a self-guided vehicle operation section, the ground-based signalling of AWS type would have to be reactivated, in order to impose again to the self-guided vehicles a stop or a mono-directional moving in the direction of the vehicle with manual vehicle operation. This anti-collision safety measure so imposes a restriction of moving versatility to the self-guided vehicles.

One of the main goals of the present invention is to offer a high versatility anti-collision control system for at least a first vehicle supplied with an on-board automatic vehicle operation.

The invention thus describes an anti-collision control system for at least a first vehicle supplied with an on-board automatic vehicle operation (=self-guided), allowing bi-directional moving on a sole track under the control of a ground-based automated traffic control unit, of CBTC type as it is called. The ground-based automated traffic control unit generally is a network (or/and sub-networks) comprising points of access (of WLAN (Wireless Local Area Network) type for example), distributed along the track, being able to communicate (radiofrequency) with the vehicle by means of an on-board router which receives the instructions of motion that are physically executed by means of an on-board controller.

In particular, said system comprises:

- a signalling control unit of AWS type controlling ground-based signals on a mono-directional running track section,
- a first default control mode according which the signalling control unit imposes a mono-directional motion to the vehicle running on the mono-directional running track section, in order to avoid any collision with another vehicle controlled only by the signalling control unit of AWS type, that is independently from the ground-based automated traffic control unit.

A first advantage of the invention is that a second control mode is able to be activated, according to which a moving of the vehicle with automatic/manual vehicle operation in opposite directions over at least a part of the initially mono-directional running track section can be initiated by means of a request of control priority coming from the automated traffic control unit CBTC and sent to the signalling control unit AWS which returns an authorization (or refusal) signal RESP to the request. In other words, the default control mode is able on an ad hoc basis and temporarily to be switched, and grants its control priority to the automated traffic control unit CBTC, if no risk of accident with a manually controlled element remains. This way, a self-guided vehicle can be exceptionally self-guided, while being on a section of AWS type, from which follows a significant versatility improvement of its bi-directional motions on an initially one-way track while ensuring a reliable anti-collision system. After the sending of an authorized response to the request, the signalling control unit AWS enforces a forbidding control of the going in of MT-typed vehicles (non-controllable by the CBTC) on the track of CBTC TS type.

It should be noted that the request coming from the automated traffic control unit CBTC and sent to the signalling control unit AWS is transmitted only with the safety guarantee of an absence of any non-controllable vehicle by the automated traffic control unit CBTC which may be on the initially mono-directional running track section AWS TS or in its neighbourhood. The type in question of a non-controllable vehicle by the CBTC automated traffic control unit is a vehicle of MT type as it is called, incompatible with a control of the automated traffic control unit CBTC, as it is completely manually operated like one of the MT1, MT2 vehicles of FIG. 1. Thus, the request of mode switching according to the invention is preceded by an authorization specific to the automated traffic control unit CBTC or from a subsidiary control box, other than the signalling control unit AWS which is mostly "blind" concerning the vehicles with automatic pilot. In practice, the safety guarantee aforementioned is done (before the sending of the request) by an operator who controls a presence or a forecast of the traffic of "manual" type under the track section destined for the coming switch to the automatic control mode (because the automated traffic is already auto-controlled by the automated traffic control unit CBTC). In particular, the operator has the knowledge of the state of the track sensors or other presence detectors (commonly called "Circuit of Track or COT") indicating the presence of a vehicle with "manual" vehicle operation of MT type on the considered track section.

A set of sub-claims also presents advantages of the invention.

Figure 3:
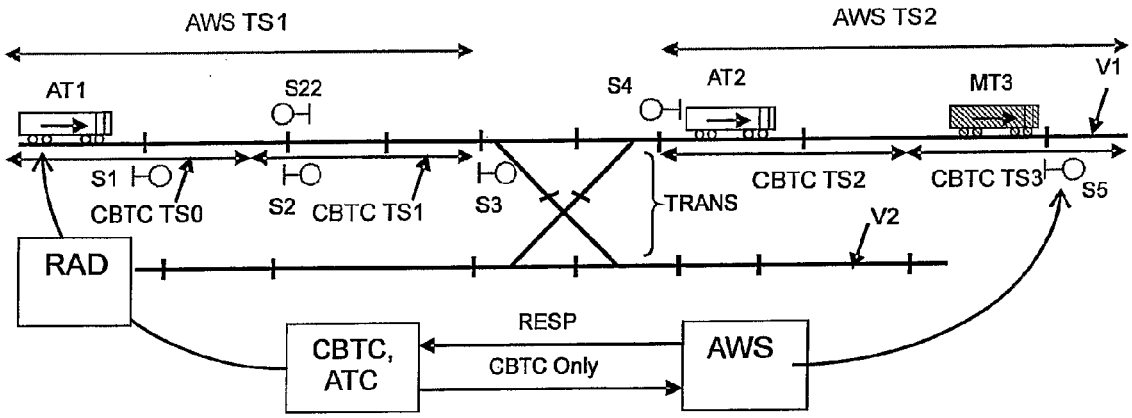
Figure 4:
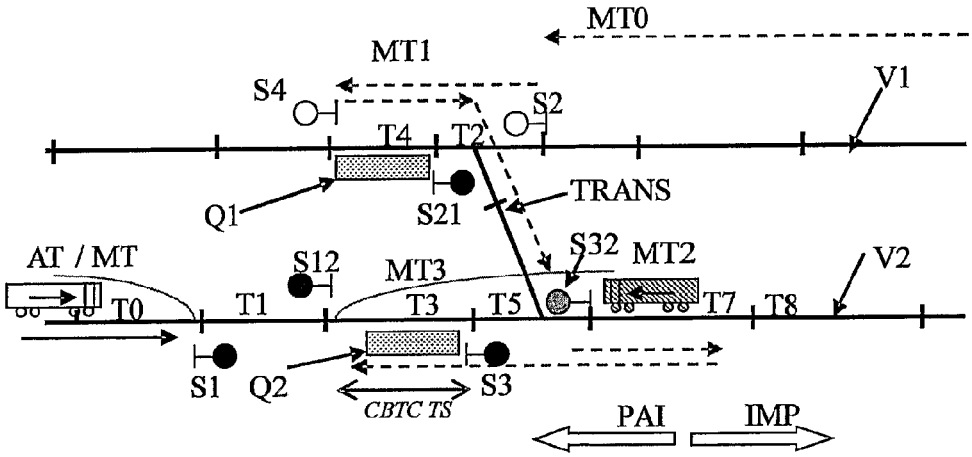

Examples of achievement and of application are given thanks to the described figures:

FIG. 3: a first architecture of the anti-collision system,

FIG. 4: a second architecture of the anti-collision system.

FIG. 3 describes a first architecture of the anti-collision system according to the invention for two situations respectively shown upstream and downstream from a track V1. Up-stream from the track V1, a first self-guided vehicle AT1 can move on a track part AWS TS1 initially controlled by an signalling control unit AWS (managing the light signals S1, S2, S3, S4 shown on the ground at track V1 level). On this track part AWS TS1, the vehicle AT1 so runs in a mono-directional way from the left to the right under the default control mode coming from the signalling control unit AWS.

For the first vehicle AT1, a second control mode is then able to be activated, according to which its moving in opposite directions on at least a part (here, for example, the part CBTC ISO or/and the part CBTC TS1) of the initially mono-directional running track section AWS TS1 is initiated by a request CBTC Only of request of control priority coming from an automated traffic control unit CBTC, ATC and sent to the signalling control unit AWS that returns an authorization or refusal signal RESP to the request. In case of granted authorization (positive RESP response, because there is no risk of a collision with a vehicle with manual vehicle operation on the parts CBTC TS0, CBTC TS1), the automated traffic control unit CBTC, ATC transmits at least an instruction relating to the moving for which the vehicle AT1 has been given authorization through a radio link RAD. The signals S1, S2, S22, S3, S4, S5 controlled by the signalling control unit AWS can then be switched-off/inhibited in order not to mislead a driver of the vehicle AT1. The control mode then has completely switched according to the invention on at least one of the bi-directional working parts CBTC TS0, CBTC TS1.

Between the two parts upstream and downstream from the track V1 is a transit zone TRANS which enables a link between the track V1 and an additional track V2, of the same type as the track V1. Around this transit zone TRANS on the first track V1, two manoeuvre signals S3, S4 (that is controllable by the signalling control unit AWS) secure the beginning or the end of the bi-directional working section in order to avoid a collision between vehicles passing from one track to another or going out of each section AWS TS1, AWS TS2 towards the transit section TRANS.

Downstream from the track V1, a vehicle AT2 with self-guided vehicle operation and a vehicle MT3 with manual vehicle operation run on a mono-directional running (from the left to the right) track part AWS TS2 and under the default control mode of the signalling control unit AWS. Advantageously, the invention then allows, with the sending of a request such as described above, to ask for an implementation of sections CBTC TS2, CBTC TS3 of the initial section AWS TS2, in order to prevent any collision over safety distances. On the first section CBTC TS2, the first vehicle AT2 so is authorized to run in a bi-directional way and on the second section CBTC TS3, the second vehicle MT3 will only run in a mono-directional way, if it does not have any on-board automatic vehicle operation able to be activated under the control mode of the automated traffic control unit CBTC.

It should be noted that the signalling control unit AWS centrally controls ground-based signals distributed along the tracks, and manages the manoeuvres of all the vehicles with "manual" vehicle operation. As a matter of fact it is this control unit which receives, interprets the CBTC Only request and generates the authorization or refusal response RESP for a control/management platform ATC of the automated traffic control unit CBTC which allows the communication interface with the potentially bi-directional operation vehicles. Afterwards in the invention and for clarity reasons, only the AWS and CBTC types will be used however. Likewise, the references of track parts allowing the running of mono- or bi-directional vehicles will be implicitly referred to by sections of type AWS TS and CBTC TS. A list of abbreviations at the end of the description can also be consulted to guide the reader.

The CBTC Only request and the authorization signal RESP can be advantageously very simple, such as under the form of binary-typed signals appropriate for at least a predefined part CBTC TS of the mono-directional running section AWS TS. That way, it is possible to define ground-based electrical relays predefining sub-parts of track of AWS TS type and switching the AWS TS type from a mode to another (=to the other type CBTC TS) thanks to the change of control mode according to the invention, in particular if it is sure or predictable that a vehicle with "manual" vehicle operation does not or will not run on a sub-part of CBTC TS part.

Indeed, a logic calculator can be comprised in the signalling control unit and so ensure a simple processing of the CBTC Only request as well as deliver a positive or negative response about the activation of a new control mode of a vehicle on a track sub-part (through an electrical relay).

Request of safety nature handled by an operator or: The CBTC Only request can also comprise instantaneous and predictable information about the motion (location, destination, etc) of the vehicle with automatic vehicle operation or not (of type AT, MT). This implies that the signalling control unit AWS can do a more complex analysis of the request. For situations of temporary nature, the request and the response can be re-submitted periodically, in order to warn about an approach, even an unexpected going in of vehicle of manual type on a part of track CBTC TS, in which case the signalling control unit AWS is taking back the control mode. So the authorization signal RESP can have a validity with a duration predetermined by the signalling control unit AWS and remains permanently able to be deactivated by inhibition.

Thus, the invention ensures a high versatility while ensuring absolute safety in case of dysfunction of any element of the anti-collision system.

In summary, it is important that in the case of an accepted authorization signal RESP, the automated traffic control unit CBTC controls at least an authorized bi-directional working section CBTC TS, provided that the signalling control unit AWS keeps on ensuring that no other MT-typed vehicle with manual vehicle operation is, goes in, runs or is authorized to run on the authorized bi-directional working section CBTC TS or, worse, is on risky approach phase of the said authorized section CBTC TS.

FIG. 4 describes a second architecture of the anti-collision system according to the invention, particularly well suited for a change of track (also called temporary service, before arriving at the station for example) done by a vehicle of type MT with "manual" vehicle operation here from a first track V1 towards a second track V2 through a transit section TRANS, such as a switch controlled by electrical signals (here through the signalling control unit of AWS type, but if the operation type of the vehicle was automatic, the automated traffic control unit CBTC could switch to priority control mode). According to FIG. 4, the two possible traffic opposite directions are referenced as even direction EVE or odd direction ODD. Furthermore, a vehicle with automatic vehicle operation is listed as AT-typed and a vehicle without automatic vehicle operation or which automatic vehicle operation is inactivated even faulty or from which the automated traffic control unit CBTC is temporarily disconnected, is listed as MT-typed. The concerned MT-typed vehicle is, for clarity reasons, only shown on a track part T7 in position MT2. However, one must understand that the same vehicle runs according to the route delimited by the arrows drawn as dotted lines comprising various main positions MT0, MT1, MT2, MT3 of said vehicle.

In this example, a MT-typed vehicle (position MT0) is moving on the first track V1 with even initial traffic from a section T2 towards a section T4, both of them of AWS TS type, which section T2 is linked to the transit section TRANS ending at the second track V2 on a section T5. The section T4 can comprise a platform Q1 for passengers in front of which the vehicle MT stops (position MT1) before leaving again in direction of the section T2 to insert itself in the transit zone TRANS. A ground-based signal S21 authorizes or blocks the vehicle MT by the transit zone TRANS, so as the MT-typed vehicle can go without collision risk in a new section T7 of the second track V2 (position MT2). If a second vehicle had to be or to close in irremediably in the even direction on the second track V2 from a section T8 of the section T7, the signal S21 blocks the first vehicle MT in position MT1. In the converse case, the vehicle initially alongside quay crosses the transit zone and joins the section T7 of the second track V2.

If the MT-typed vehicle is in transit zone TRANS, blocking signals S8, S32 and S1, S3 are activated upstream and downstream from the transit final section T5, so as to ensure the stop of other MT-typed vehicles, far enough from the MT-typed vehicle arriving at the section T7. Thus, in a case of collision risk between these MT-typed vehicles, the signalling control unit is in control mode.

If however, the MT-typed vehicle is in transit zone TRANS so as to arrive at the section T7, other AT-typed vehicles on the second track V2 (and controlled according to the invention by the new control mode through a CBTC automated traffic control unit) have to be adequately blocked to avoid any collision. Of course, it is possible to cancel the CBTC-typed control mode in order to manage the situation with the sole signalling for AT- and MT-typed vehicles; however the invention allows a traffic management more versatile by allowing the AT-typed vehicles to run freely in an automated way (without signalling) in a delimited zone T8 following the section T7 (with signalling) in the even/odd direction. On this delimited zone T8, an AT-typed vehicle will be automatically blocked under control of the automated traffic control unit CBTC and so will not go in the section T7 of arrival of the first vehicle MT coming from the transit zone TRANS.

After the arrival of the first vehicle MT in the section T7, its running direction on the second track V2 can be defined as even, for the purpose of reaching a new platform Q2 for passengers located on a section T3, separated from the section T7 by the end of transit zone TRANS, T5 which should be secured as for a new arrival from the first track V1.

Two possibilities can then occur:

in order to prevent any other MT-typed vehicle to run in the odd direction towards the first MT-typed vehicle coming from its position MT2 in the even direction or at a stop in the section T3 (by the platform Q2), the signalling control unit AWS restores a mono-directional running direction on the second track V2 in the even direction. This implies, in that example, that a vehicle blocking signal S1 already launched in the odd direction (to be deactivated because the even direction is chosen) has to be placed sufficiently far away from the platform Q2, so as to take in account the braking distance (wheel slide zone) of the vehicle to stop. This operation is completely feasible by means of the signalling control unit AWS.

in order however to block any other AT-typed vehicle to run in the odd direction towards the first MT-typed vehicle coming from its position MT2 in the even direction or at a stop in section T3 (by the platform Q2), the invention allows to stop automatically the AT-typed vehicle before the platform Q2 (the control mode by the signalling control unit is then inoperative). This way, an AT-typed vehicle driver cannot be taken by surprise, unlike the one of a MT-typed vehicle which momentum in the odd direction (not wished) makes it cross the blocking signal S1 and will have to brake brutally in order to stop before the platform Q2.

So the invention can be advantageously used to an end of secured blocking of the AT-typed vehicle, in the sense that the automated traffic control unit CBTC forbids the first vehicle AT to run on or to access to a part T3 of bi-directional working authorized section CBTC TS if the first vehicle AT and the second vehicle MT (aiming at the platform Q2) are on mutual approach, in particular if the second vehicle MT reaches the part T3 before the first vehicle AT.

In order to allow a mixing of those two possibilities, FIG. 4 presents a first advantage which consists in having a section CBTC TS by the section T3 (platform Q2). For that reason, and according to the invention, given the fact that a switch of the control mode on the automated traffic control unit is ensured on the section T3, no AT-typed vehicle can cause a collision with the first vehicle alongside quay or reaching the platform. On the other hand, a precaution is coming from having a section T1, which can be of type AWS TS, between the section T0 of CBTC TS type and the section T3 (platform Q2) also of CBTC TS type. This has the effect of providing any MT-typed vehicle with a stopping distance thanks to the signalling by the section T1 as an approach zone of the platform Q2 on which is arriving or is parking a vehicle.

This also ensures that an AT-typed vehicle in the odd direction cannot reach the intermediate section T3 secured according to the invention. In summary, it is possible to juxtapose parts of type CBTC TS, AWS TS when nearing a collision zone with a vehicle, so as to be able to ensure an anti-collision of this vehicle with a mixing of types AT, MT of other vehicles.

Thus, by insertion of sections of type CBTC TS for a mixed network AWS/CBTC, a first increase of traffic versatility is reached, because the AT-typed vehicles can take advantage of their bi-directional ability without resorting to a ground-based signalling that would prevent it on parts secured in a conventional way. This aspect then offers the ability to adapt an automated traffic control unit CBTC in a more versatile way to an already existing AWS signalling control unit. Moreover, MT-typed vehicles are not put in jeopardy by a vehicle with automatic vehicle operation.

In case of failure of an on-board automatic vehicle operation in an AT-typed vehicle (so the vehicle is suddenly comparable to a MT-typed vehicle), the signalling control unit AWS can activate elements or signals of braking, of blocking or of mandatory mono-directional running of this vehicle AT in the periphery (section T1) of the section T3 authorized to a bi-directional running of CBTC TS type. The section T1 of AWS TS type thus ensures a control over vehicles without automatic vehicle operation or forced to be controlled manually.

It is also implied that the present anti-collision system does not limit itself to one sole automated traffic control unit CBTC. The signalling control unit AWS comprises an interoperability adaptator to evaluate the priority of several requests (under previous safety guarantees) coming from a plurality of automated traffic control units CBTC, these able to have in particular different control protocols. Likewise, the terminology "signalling control unit AWS" implies a signalling network or/and signalling sub-networks (associated with ground-based signals) controlled by at least one signalling control unit AWS.

List of Abbreviations

AT vehicle with automatic vehicle operation ("Automatic Train")

ATC automated traffic controller ("Automatic Train Control")

AWS signalling control unit ("Auxiliary Wayside System" also named "Interlocking")

AWS TS traffic section controlled by AWS or IXL ("Traffic Section handled by AWS")

CBTC automated traffic control unit ("Communication Based Train Control")

CBTC TS traffic section controlled by CBTC ("Traffic Section handled by CBTC")

MT vehicle with manual vehicle operation ("Manual Train")

TS traffic section or track part ("Traffic Section")

The indexes added to the basic abbreviations above, such as AT1, AT2 or MT1, MT2 or AWS TS1, AWS TS2 or CBTC TS1, CBTC TS2, etc, indicate that an element is part of the category pointed out by the basic abbreviation.

The invention claimed is:

1. An anti-collision control system for a vehicle equipped with on-board automatic vehicle operation, allowing bi-directional motion on a single track under control of a ground-based automated traffic control unit, the system comprising:

a signaling control unit controlling ground-based signals on a track section with mono-directional running;

a first default control mode in which said signaling control unit imposes a mono-directional motion to the vehicle moving on the mono-directional running track section;

a second control mode, to be selectively activated, in which a movement of the vehicle in opposite directions on at least a part of the track section of an initially mono-directional running nature is initiated by a request of control priority coming from the automated traffic control unit and sent to the signaling control unit, wherein the signaling control unit returns an authorization signal to the request.

2. The system according to claim 1, wherein the request and the authorization signal are binary-type signals appropriate for at least a predefined portion of the mono-directional running section.

3. The system according to claim 1, wherein the request is initiated only on the proviso of a safety guarantee regarding an absence of a vehicle from the track section of an initially mono-directional running nature or from a neighborhood thereof, and if the vehicle is incompatible with a control of the automated traffic control unit.

4. The system according to claim 1, wherein said signaling control unit includes a relay or a logic calculator, and the response is delivered through said relay or logic calculator of said signaling control unit.

5. The system according to claim 1, wherein, if an authorization signal is granted, the automated traffic control unit controls at least a bi-directional working authorized section, provided said signaling control unit guarantees that no other vehicle with a manual vehicle operation runs or is allowed to run on the bi-directional working authorized section.

6. The system according to claim 5, wherein the automated traffic unit control forbids the first vehicle to run on or to access a portion of bi-directional working authorized section if a first vehicle and a second vehicle are on mutual approach.

7. The system according to claim 6, wherein the automated traffic unit control forbids the first vehicle to run on or to access a portion of bi-directional working authorized section if the second vehicle reaches the portion before the first vehicle.

8. The system according to claim 6, wherein the second vehicle with a manual vehicle operation is either without on-board automatic vehicle operation, or supplied with an on-board automatic vehicle operation being able to be deactivated, even faulty, or from which the automated traffic control unit is temporarily disconnected.

9. The system according to claim 5, wherein said signaling control unit is configured to control active elements or visual signals for the braking or the blocking of a second vehicle on or in a periphery of an authorized section of bi-directional working nature.

10. The system according to claim 5, wherein said signaling control unit is configured to activate elements or signals of braking, of blocking or of mandatory mono-directional running of the first vehicle at a periphery of an authorized section of bi-directional working nature.

11. The system according to claim 4, wherein said signaling control unit includes an interoperability adaptor for evaluating a priority of several requests coming from a plurality of automated traffic control units.

12. The system according to claim 11, wherein said interoperability adaptor is configured to evaluate requests with different control protocols.

13. The system according to claim 1, wherein the authorization signal has a validity with a duration predetermined by the signaling control unit and remains permanently available for deactivation by inhibition.

14. The system according to claim 1, wherein the vehicles are public transport vehicles.

15. The system according to claim 14, wherein the vehicles are selected from the group consisting of a guided bus, a tramway car, a trolley bus, a train, and another railway unit.

16. The system according to claim 1, wherein pairs of juxtaposed sections are inserted by a zone of collision risk initially controlled by said signaling control unit or by the automated traffic control unit.

* * * * *